US006728509B2

(12) United States Patent
Cornelius

(10) Patent No.: US 6,728,509 B2
(45) Date of Patent: Apr. 27, 2004

(54) IMAGING MEDIA HANDLING PACKAGE

(75) Inventor: William L. Cornelius, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/815,587

(22) Filed: Mar. 23, 2001

(65) Prior Publication Data

US 2002/0136575 A1 Sep. 26, 2002

(51) Int. Cl.[7] ..... G03G 15/00
(52) U.S. Cl. ..... 399/393; 399/389
(58) Field of Search ..... 399/388, 389, 399/393; 271/145, 240, 241; 206/449, 555

(56) References Cited

U.S. PATENT DOCUMENTS 3,767,188 A * 10/1973 Rosenberg et al. ..... 221/287
4,032,137 A * 6/1977 Katayama et al. ..... 271/145
4,214,662 A * 7/1980 Jonas ..... 206/555
4,770,301 A * 9/1988 Nagel ..... 206/449
4,780,740 A * 10/1988 Fukae ..... 399/86
5,053,814 A * 10/1991 Takano et al. ..... 271/145
5,137,269 A * 8/1992 Yamamoto ..... 206/454
5,314,179 A * 5/1994 Oda et al. ..... 271/215
5,433,427 A * 7/1995 Ishikawa et al. ..... 271/126
6,227,732 B1 * 5/2001 Higuchi et al. ..... 206/449
6,246,466 B1 * 6/2001 Hirano et al. ..... 271/145

FOREIGN PATENT DOCUMENTS

JP 04113876 A * 4/1992 ..... B41J/29/50

* cited by examiner

*Primary Examiner*—Robert Beatty

(57) ABSTRACT

An imaging media handling system is described in the context of an imaging system adapted and constructed to form images on imaging media of differing sizes and materials. The imaging system includes a magazine adapted and constructed to retain stacks of imaging media for infeeding into an image forming mechanism within the imaging system. A resealable imaging media package is provided to hold a stack of imaging media. An imaging media package retaining mechanism is associated with the magazine of the imaging system. The resealable imaging media package is loaded into, and retained within, the magazine, making the imaging media within the package available for infeeding into the image forming mechanism. A method for loading and containing sheets of imaging media in an image forming mechanism within an imaging system is also disclosed.

11 Claims, 4 Drawing Sheets

IMAGING MEDIA HANDLING PACKAGE

FIELD OF THE INVENTION

The invention relates generally to imaging media handling and packaging. Specifically, the invention relates to a method and apparatus for the loading and containment of imaging media inside an imaging system.

BACKGROUND OF THE INVENTION

Imaging systems such as printers, fax machines, and copiers are virtually omnipresent, and can be found in homes and offices worldwide. The development of such systems has facilitated improvements in communications that have in turn fostered a sea change in the ways that people live and work. Telecommuting, paperless offices, and intra-office networks represent but a few examples of the advancements that have been made possible by modern imaging systems.

Since these systems have become crucial to everyday existence, their reliability and smoothness of operation is paramount. It is therefore vitally important to design imaging systems so that downtime and work interruptions are minimized. This can be a daunting challenge, given the relative complexity of systems in which the size and material of imaging media moving through a single system can vary greatly.

Known imaging systems typically include media input trays that contain stacks of imaging media, commonly in the form of sheets of paper, transparencies and the like. In operation, the user removes the input tray from the imaging system, and places it on a flat surface. In many trays, side and rear input guides must be adjusted to fit the size of the imaging media. The imaging media is then removed from its packaging and loaded into the tray. This is typically done in small batches, ensuring that the separation tabs are above the corner of the stack. The tray is then replaced into the imaging system, making it operational.

With the tray installed in the system, the imaging media is exposed to the heat, dust, and residue in the internal environment of the imaging system. Further, the imaging media in the tray tends to acclimate to temperature and humidity, which can cause print quality errors, feeding errors, and media deformation problems. Acclimation can cause toner explosions and triboelectric induced defects, and curled and waved media. Known loading systems are also subject to human error, such as misaligned stacks or overloaded trays. Mechanical errors can also occur, such as misalignment or skew caused by side guides "floating" due to wear or manufacturing tolerances.

Some imaging system and imaging media providers recommend image forming within a fairly narrow range of temperature (68° F. to 75° F.) and humidity (4% to 6%). These are conditions similar to those under which the imaging media are packaged. Some of these same providers suggest returning the media to its original package if it is not going to be used for long intervals. Unfortunately, this advice is seldom read, much less followed, and the vast majority of media packaging is simply discarded after the media is loaded into the imaging system.

It can be seen from the foregoing that the need exists for a simple, inexpensive system for loading and containment of imaging media inside an imaging system that overcomes the deficiencies of known arrangements.

SUMMARY OF THE INVENTION

The media handling system is described in the context of an imaging system adapted and constructed to form images on imaging media of differing sizes and materials. The imaging system includes a magazine adapted and constructed to retain stacks of imaging media for infeeding into an image forming mechanism within the imaging system. A resealable imaging media package is provided to hold a stack of imaging media. An imaging media package retaining mechanism is associated with the magazine of the imaging system. The resealable imaging media package is loaded into, and retained within, the magazine, making the imaging media within the package available for infeeding into the image forming mechanism.

In an embodiment, the retaining mechanism can include a centering mechanism adapted and constructed to place and retain packages in a centered position within the magazine. The retaining mechanism can also include a size detection mechanism adapted and constructed to determine the size of imaging media inserted into the magazine. One or both of these functions can be accomplished by providing a plurality of spring-loaded side guides on opposite sides of the magazine.

In another aspect of the invention, the resealable imaging media package includes a closure member adapted and constructed to selectively move between an open position exposing the imaging media within the package, and a closed position enclosing the imaging media within the package. The closure member can be provided as a frangible closure, such as a pull string or interlocking channel arrangement. A frangible closure breaks the seal of the resealable imaging media package, dividing the package into an imaging media retaining portion and a replaceable package top. Alternatively, the closure member can be provided as a folded closure that remains secured to the package in both the open position and the closed position.

A method for loading and containing sheets of imaging media in an image forming mechanism within an imaging system is also disclosed. In a first step, sheets of imaging media are enclosed in a package. Next, a portion of the package is moved to enclose a first section of the sheets of the imaging media within the package while exposing a second section of the sheets of the imaging media. The package is then inserted into the imaging system, and the imaging system is operated to form an image on at least one of the sheets of imaging media. The package is next removed from the imaging system, and then resealed.

DETAILED DESCRIPTION OF THE INVENTION

Figure 1:
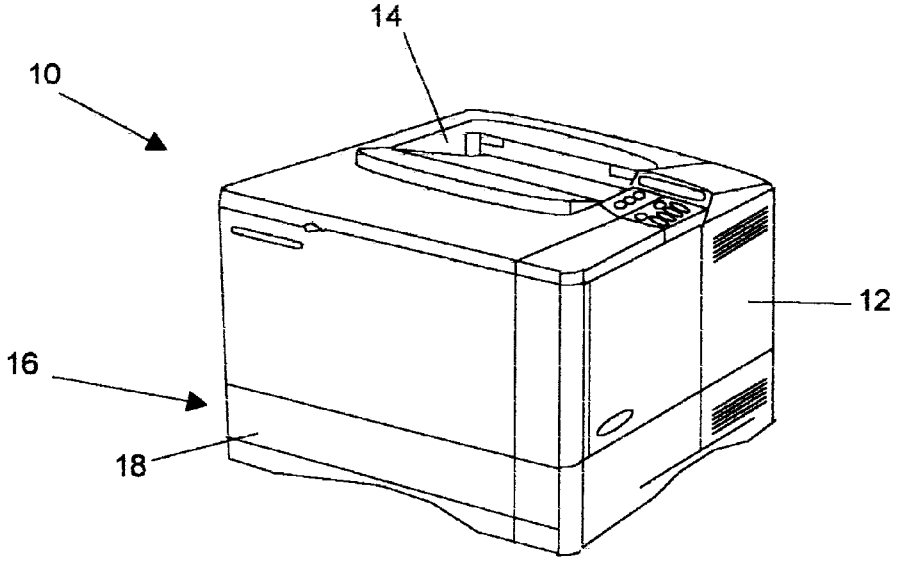
FIG. 1 is a schematic perspective view of an imaging system incorporating the principles of the present invention.

FIG. 1 illustrates an imaging system 10 in accordance with the principles of the present invention. Although the present invention is applicable to any imaging system in which imaging media in the form of sheet material is handled, the imaging system 10 is herein illustrated as a printer 12 including an output tray 14 and an imaging media input section 16 including an access door 18.

Figure 2:
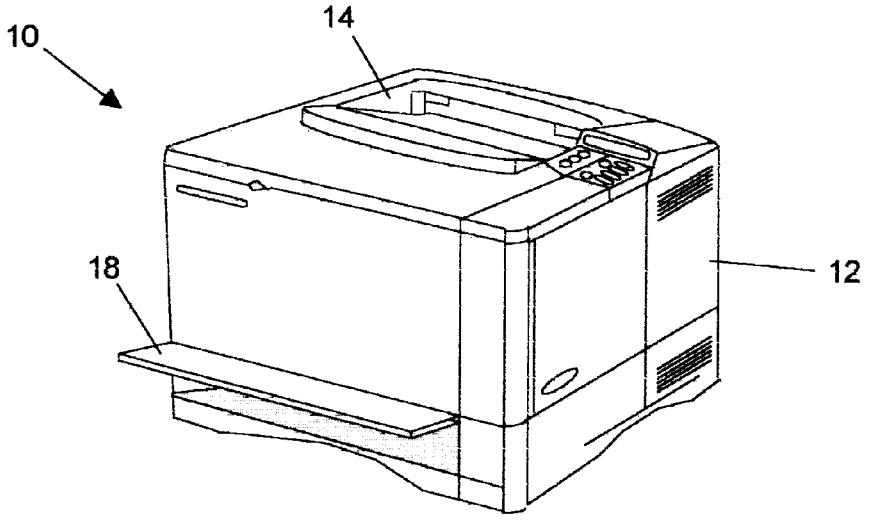
FIG. 2 is a schematic perspective view of the FIG. 1 imaging system, with an access door in its open position.

The access door 18 is shown in its open position in FIG. 2, which permits the insertion of sheets of imaging media, typically in stacks, into the input section 16. Imaging media can be in any known form, but typically are provided as paper, transparencies, transfer material, and the like. Sheets from the stack imaging media stack are fed into, and processed by, the printer 12, and fed out of the printer 12 onto the output tray 14.

Figure 3:
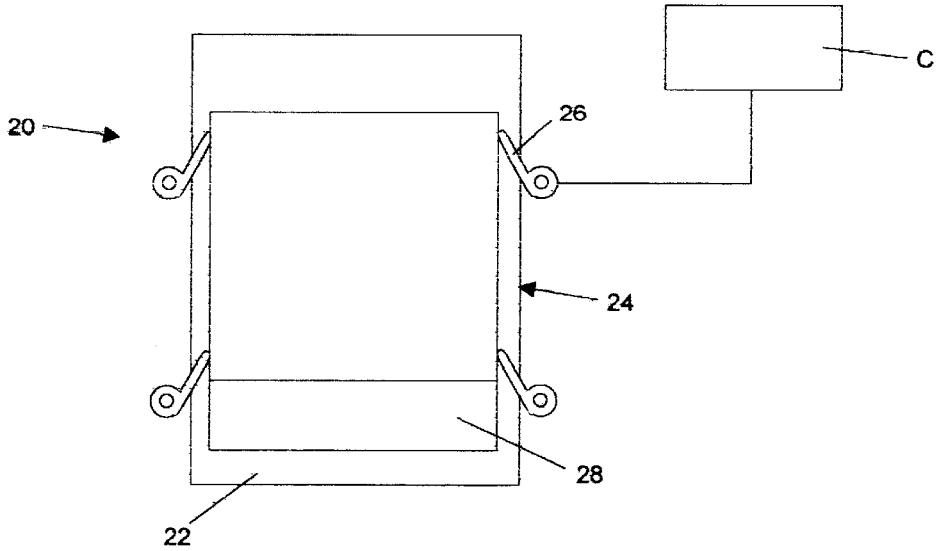
FIG. 3 is a schematic plan view of an imaging media package and an imaging media package retaining mechanism.

As shown in FIG. 3, the input section 16 of the printer 12 includes an imaging media handling system 20. The imaging media handling system 20 includes a magazine 22 adapted and constructed to retain stacks of imaging media for infeeding into an image forming mechanism (not shown) within the printer 12. An imaging media package retaining mechanism 24 is associated with the magazine 22, and is here illustrated as a plurality of spring-loaded side guides 26 provided on opposite sides of the magazine 22. The side guides 26 serve as a centering mechanism to place and retain packages in a centered position within the magazine 22. Using known sensing and signal detection mechanisms, the side guides 26 can also serve as a size detection mechanism capable of determining the size of imaging media 28 inserted into the magazine 22, and to relay size information to a control system C of the imaging system 10.

Figure 4:
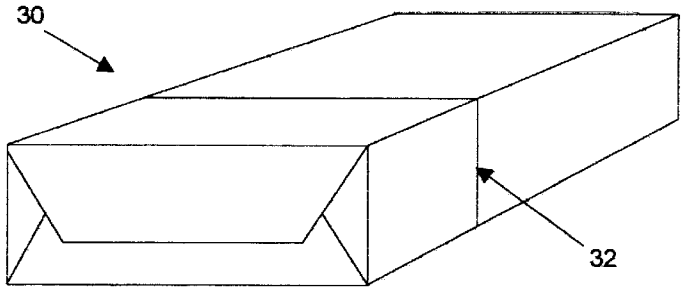
FIG. 4 is a schematic perspective view of an imaging media package.
Figure 5:
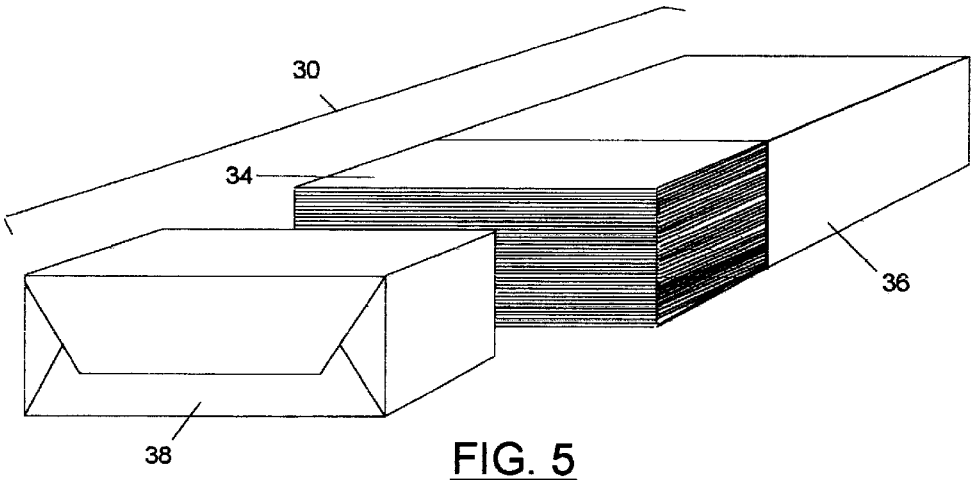
FIG. 5 is a schematic perspective view of the FIG. 4 imaging media package with its replaceable package top removed.

The imaging media handling system is adapted for use with a novel resealable imaging media package 30, implemented in accordance with the present teachings as shown in FIGS. 4 and 5. The package 30 can contain any suitable number of sheets of imaging media. For example, it is typical for sheets of paper to be packaged in quantities of 500 sheets, or one ream. The imaging media package 30 includes a frangible closure element 32. The frangible closure element 32 can be provided as a pull string or resealable interlocking channel arrangement, the physical details of which will be familiar to those of skill in the art. The frangible closure member 32 enables the package 30 to selectively move between an open position exposing the imaging media 34 within the package 30, and a closed position enclosing the imaging media 34 within the package 30. In the FIG. 4 position, enough of the imaging media 34 is exposed to make the imaging media within the package available for infeeding into the image forming mechanism, here by exposing approximately ⅙th of the surface area of the imaging media contained therein. In the open position, the package 30 is divided into an imaging media retaining portion 36 and a replaceable package top 38. If the frangible closure member 32 is provided as a pull string, the package top 38 is merely slid back into a closed position. If the closure member 32 is provided as an interlocking channel arrangement, the package top 38 is slid back into a closed position, and the interlocking channel is resealed, as with a typical plastic storage bag. It is also contemplated that other frangible seals could be used, for example, hook-and-loop fasteners such as VELCRO®.

Figure 6:
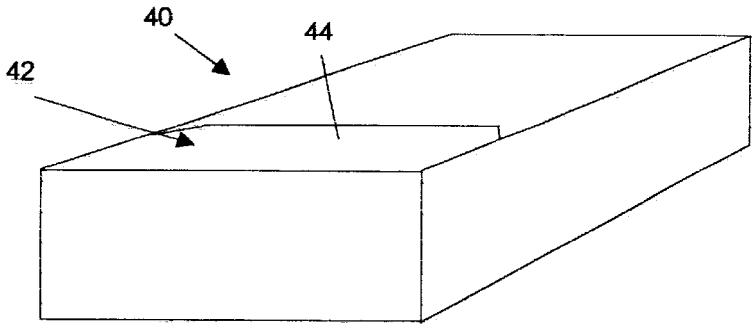
FIG. 6 is a schematic perspective view of another embodiment of an imaging media package.
Figure 7:
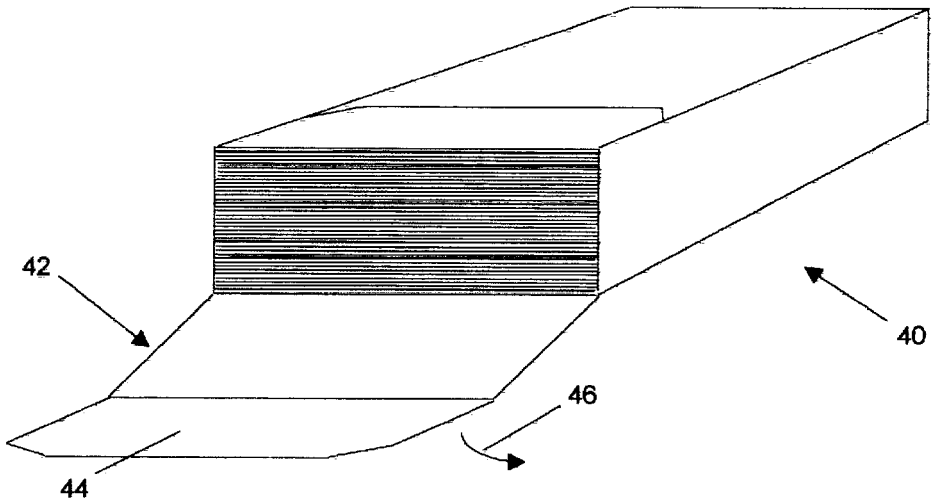
FIG. 7 is a schematic perspective view of the FIG. 6 imaging media package with its closure member partially opened.
Figure 8:
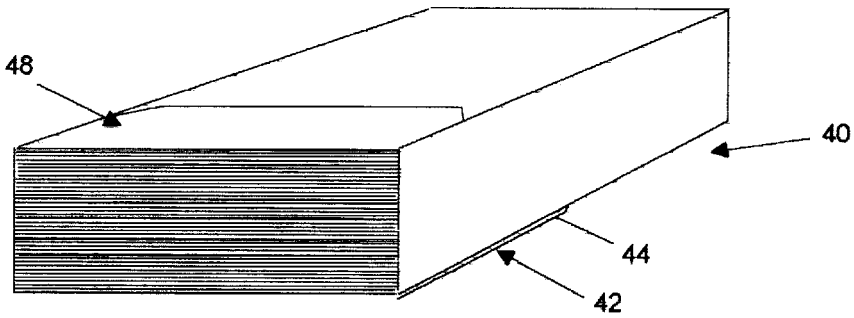
FIG. 8 is a schematic perspective view of the FIG. 6 imaging media package with its closure member fully opened.

An alternative imaging media package 40 is shown in FIGS. 6 through 8. The package 40 includes a folded closure member 42. The closure member 42 includes a flap 44 that is secured to the package 40 with resealable adhesive. The flap 44 remains secured to the package in both the open position and the closed position, and in operation is unstuck from the top of the package 40, folded over as shown in FIG. 7, and stuck to the bottom of the package 40 as shown in FIG. 8, exposing the imaging media 48. In the open position, enough of the imaging media 48 is exposed make the imaging media within the package available for infeeding into the image forming mechanism.

Operation of the invention is as follows. First, sheets of imaging media are enclosed in a resealable package. Next, a portion of the package is moved to enclose a first section of the sheets of the imaging media within the package while exposing a second section of the sheets of the imaging media. The portion of the package can be moved either by being folded back or removed from the rest of the package. The opened package is then inserted into the imaging system, and the imaging system is operated to form an image on at least one of the sheets of imaging media. The package is next removed from the imaging system, and then resealed.

Figure 9:
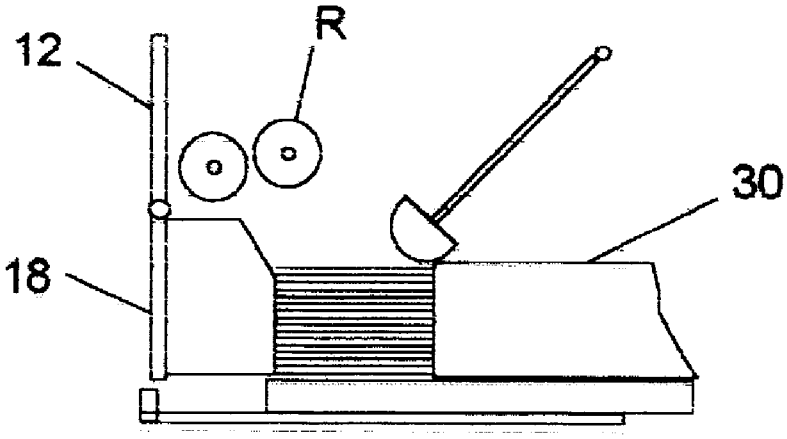
FIG. 9 is a schematic side sectional view of an imaging media package within an imaging media package retaining mechanism.

FIG. 9 illustrates the package 30 in place in the retaining mechanism 24. The door 18 lifts upwardly to load the package 30, and closes to seal the magazine 22 and package 30 from the environment. The door 18 is contoured to guide the image media sheets upwardly, through retard rollers R, which feed the media into the image processing portion of the printer 12. It is also contemplated that the door 18 can be hinged from the bottom, with the paper guide contours being retractable if necessary to permit unobstructed insertion of media. This could provide improved accessibility to the magazine 22.

The present invention helps reduce loading-induced multifeeds, input jams, and misfeed due to misaligned media stacks. Since sliding side guides and back stops are eliminated, the likelihood of skew is also reduced. The need for fewer parts in the infeed tray makes fabrication and servicing simpler, and potentially reduces the footprint of the imaging system, using less desk or workspace area.

Although the present invention has been described with reference to specific embodiments, those of skill in the art will recognize that changes may be made thereto without departing from the scope and spirit of the invention as defined by the appended claims.

What is claimed is:

1. In an imaging system adapted and constructed to form images on imaging media of differing sizes and materials, the imaging system including a magazine adapted to retain stacks of imaging media for infeeding into an image forming mechanism within the imaging system, an imaging media handling system comprising the following:

a resealable imaging media package, the package being adapted and constructed to hold a stack of imaging media and to be selectively and resealably opened at a single location to expose the stack of imaging media to the infeed mechanism of the imaging system; and an imaging media package retaining mechanism associated with the magazine of the imaging system, said retaining mechanism having at least one spring loaded side guide adapted to determine the size of imaging media inserted into the magazine.

2. An imaging media handling system in accordance with claim 1, wherein the retaining mechanism comprises a centering mechanism adapted and constructed to place and retain packages in a centered position within the magazine.

3. An imaging media handling system in accordance with claim 2 wherein said centering mechanism is adapted for rotational engagement of said package.

4. An imaging media handling system in accordance with claim 1 wherein said retaining mechanism is adapted for rotational engagement of said package.

5. An imaging media handling system in accordance with claim 1, wherein the side guides is adapted and constructed to place and retain packages in a centered position within the magazine.

6. An imaging media handling system in accordance with claim 5 wherein said side guide is adapted for rotational engagement of said package.

7. An imaging media handling system in accordance with claim 1, wherein the resealable imaging media package comprises a closure member adapted and constructed to selectively move between an open position exposing the imaging media within the package, and a closed position enclosing die imaging media within the package.

8. An imaging media handling system in accordance with claim 7, wherein the resealable imaging media package comprises a frangible closure adapted and constructed to break the seal of the resealable imaging media package, dividing the package into an imaging media retaining portion and a replaceable package top.

9. An imaging media handling system in accordance with claim 8, wherein the frangible closure of the resealable imaging media package comprises a pull string.

10. An imaging media handling system in accordance with claim 8, wherein the frangible closure of the resealable imaging media package comprises an interlocking channel arrangement.

11. An imaging media handling system in accordance with claim 7, wherein the resealable imaging media package comprises a folded closure remaining secured to the package in the open position and the closed position.

* * * * *

UNITED STATES PATENT AND TRADEMARK OFFICE

CERTIFICATE OF CORRECTION

PATENT NO. : 6,728,509 B2
DATED : April 27, 2004
INVENTOR(S) : William L. Cornelius It is certified that error appears in the above-identified patent and that said Letters Patent is hereby corrected as shown below:

Column 4,
Line 10, after "exposed" insert -- to --

Column 5,
Line 19, delete "die" and insert therefor -- the --

Signed and Sealed this

Eleventh Day of January, 2005

JON W. DUDAS
*Director of the United States Patent and Trademark Office*